US006137979A

United States Patent [19]

Gartstein et al.

[11] Patent Number: 6,137,979

[45] Date of Patent: Oct. 24, 2000

[54] TONER TRANSPORT USING SUPERIMPOSED TRAVELING ELECTRIC POTENTIAL WAVES

[75] Inventors: Yuri Gartstein, Webster; Palghat S. Ramesh, Pittsford; Michael D. Thompson, Rochester, all of N.Y.

[73] Assignee: Xerox Corporation, Stamford, Conn.

[21] Appl. No.: 09/458,372

[22] Filed: Dec. 10, 1999

[51] Int. Cl.[7] ..... G03G 15/08

[52] U.S. Cl. ..... 399/266; 399/265; 399/258

[58] Field of Search ..... 399/258, 266, 399/270, 271, 272, 285, 265, 252; 198/576

[56] References Cited

U.S. PATENT DOCUMENTS

| | | | |
|---|---|---|---|
| 4,647,179 | 3/1987 | Schmidlin | 355/3 DD |
| 4,743,926 | 5/1988 | Schmidlin et al. | 346/159 |
| 4,794,878 | 1/1989 | Connors et al. | 118/653 |
| 4,875,081 | 10/1989 | Goffe et al. . | |
| 5,281,982 | 1/1994 | Mosehauer et al. | 346/159 |
| 5,541,716 | 7/1996 | Schmidlin | 399/261 |
| 5,850,587 | 12/1998 | Schmidlin | 399/258 |

*Primary Examiner*—Richard Moses
*Attorney, Agent, or Firm*—Lloyd F. Bean, II

[57] ABSTRACT

An apparatus for developing a latent image recorded on an imaging surface, including: a housing defining a chamber for storing a supply of developer material comprising toner; a donor member, spaced from the imaging surface, for transporting toner on the surface thereof to a region opposed from the imaging surface, the donor member includes an electrode array on the outer surface thereof, the array including a plurality of spaced apart electrodes extending substantial across width of the surface of the donor member; and a multi-phase voltage source operatively coupled to the electrode array, for generating a first electrodynamic wave pattern for moving toner particles along the surface of the electrode array to and from a development zone and generating a second electrodynamic wave to provide a fast oscillating-like toner motion along and perpendicular to the surface of the electrode array.

7 Claims, 10 Drawing Sheets

TONER TRANSPORT USING SUPERIMPOSED TRAVELING ELECTRIC POTENTIAL WAVES

INCORPORATION BY REFERENCE

The following is specifically incorporated by reference co-pending patent application, D/98522, U.S. Ser. No, 09/312,873, D/98523, U.S. Ser. No. 09/312,872 and D/99725, U.S. Ser. No. 09/458,373 entitled "A MULTI-ZONE METHOD FOR XEROGRAPHIC POWDER DEVELOPMENT: VOLTAGE SIGNAL APPROACH", "A METHOD FOR LOADING DRY XEROGRAPHIC TONER ONTO A TRAVELING WAVE GRID" and "A METHOD AND APPARATUS USING TRAVELING WAVE POTENTIAL WAVE FORMS FOR SEPARATION OF OPPOSITE SIGN CHARGE PARTICLES, respectively.

FIELD OF THE INVENTION

This invention relates generally to a development apparatus for ionographic or electrophotographic imaging and printing apparatuses and machines, and more particularly is directed to a device using superimposed traveling potential waves, but can be also applied in other machines and technologies which involve handling of small charged particles.

BACKGROUND OF THE INVENTION

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image, it is important to level the voltages between the previously toned and the untoned areas of the photoreceptor.

In the application of the toner to the latent electrostatic images contained on the charge-retentive surface, it is necessary to transport the toner from a developer housing to the surface. A limitation of conventional xerographic development systems, including both magnetic brush and single component, is the inability to deliver toner (i.e. charged pigment) to the latent images without creating large adhesive forces between the toner and the conveyor on which the toner rests and which transports the toner to latent images. As will be appreciated, large fluctuation in the adhesive forces that cause the pigment to tenaciously adhere to the carrier severely limits the sensitivity of the developer system, thereby necessitating higher contrast voltages forming the images. Accordingly, it is desirable to reduce the large adhesion, particularly in connection with latent images formed by contrasting voltages.

In order to minimize the adhesive forces, there is provided, in the preferred embodiment of the invention, a toner conveyor including means for generating traveling electrostatic waves which can constantly move the toner about the surface of the conveyor with minimal static contact therewith.

Traveling waves have been employed for transporting toner particles in a development system, for example U.S. Pat. No. 4,647,179 to Schmidlin which is hereby incorporated by reference. In that patent, the traveling wave is generated by alternating voltages of three or more phases applied to a linear array of conductors placed about the outer periphery of the conveyor. The force F for moving the toner about the conveyor is equal $qE_t$ where q is the charge on the toner and $E_t$ is the tangential field supplied by a multi-phase AC voltage applied to the array of conductors.

Traveling wave devices have been proposed for a number of years to transport, separate and deliver charged particles to a latent electrostatic image. Some of the other reasons this is an attractive approach include absence of moving mechanical parts, control of the toner position, long and stable development zones, and architectural flexibility. A semiconductive overcoat may be desirable on the grid providing a smooth surface for the toner motion and also a possible charge relaxation channel. Previous work has shown that various modes of charged particle transport are possible. The so-called synchronous modes of the electrostatic traveling wave transport have been found and indicated as appropriate to facilitate the toner transport that can be used for xerographic development systems. In those modes, the toner particles move along the carrying surface with the traveling wave phase velocity $v_{ph}=\omega/k$ where $\omega$ and k are the frequency and the wavevector of the wave respectively. This velocity is achieved through the action of the longitudinal (x) component of the electrostatic force while the normal (z) component of the force on the average contains the toners near the carrying surface.

In the other, so-called "curtain" or asynchronous mode, toners would be effectively repelled by the wave from the surface and could be retained only by an external force such as the gravity or another externally applied electric field. In the absence of the latter, the toners would be very loose and subject to emissions. Transport in this mode ordinarily occurs with velocities much lower than $v_{ph}$.

While being transported in synchronous modes, the toner particles, although moving on the average along the surface, still find themselves in intimate contact with it for appreciable periods of time. At the same time, while in the development zone such toners can be effectively screened by the traveling wave from the development fields.

SUMMARY OF THE INVENTION

There is provided an apparatus for developing a latent image recorded on an imaging surface, including: a housing defining a chamber for storing a supply of developer material comprising toner; a donor member, spaced from the imaging surface, for transporting toner on the surface thereof to a region opposed from the imaging surface, the donor member includes an electrode array on the outer surface thereof, the array including a plurality of spaced apart electrodes extending substantial across width of the surface of the donor member; and a multi-phase voltage source operatively coupled to the electrode array, for generating a first electrodynamic wave pattern for moving toner particles along the surface of the electrode array to and from a development zone and generating a second electrodynamic wave to provide a fast oscillating-like toner motion along and perpendicular to the surface of the electrode array.

The objective of the present invention is to provide a novel class of superimposed traveling electric potential waves which will effectively enable further reduction of contact between the carrying surface and transported particles while still sustaining the motion along the surface with velocities comparable to the wave's phase velocity. This class comprises the waveforms consisting essentially of two waves: the main running wave whose function is to transport charged particles along its propagation direction, and the second wave, whose function is to constantly and swiftly "shake" particles on the background of the main wave. The second wave has in general a higher frequency and amplitude and can be either of a shorter or comparable wavelength than the main wave. The superimposed wave can be either standing or running. The second wave also allows independent control of the height of the traveling cloud of charged particles making them more useful for development purposes because they can be presented closer to the latent image allowing more faithful reproduction of the fringe field patterns of lines and halftone dots.

BRIEF DESCRIPTION OF THE FIGURES

FIGS. 8 and 9 are top view of a portion of the flexible donor belt that can be used in the context of the present invention;

FIG. 10 is a schematic elevational view showing the development apparatus used in the FIG. 11 printing machine;

FIG. 11 is a schematic elevational view of an illustrative electrophotographic printing or imaging machine or apparatus incorporating a development apparatus having the features of the present invention therein;

Inasmuch as the art of electrophotographic printing is well known, the various processing stations employed in the printing machine will be shown hereinafter schematically and their operation described briefly with reference thereto.

DETAILED DESCRIPTION OF THE INVENTION

Figure 11:
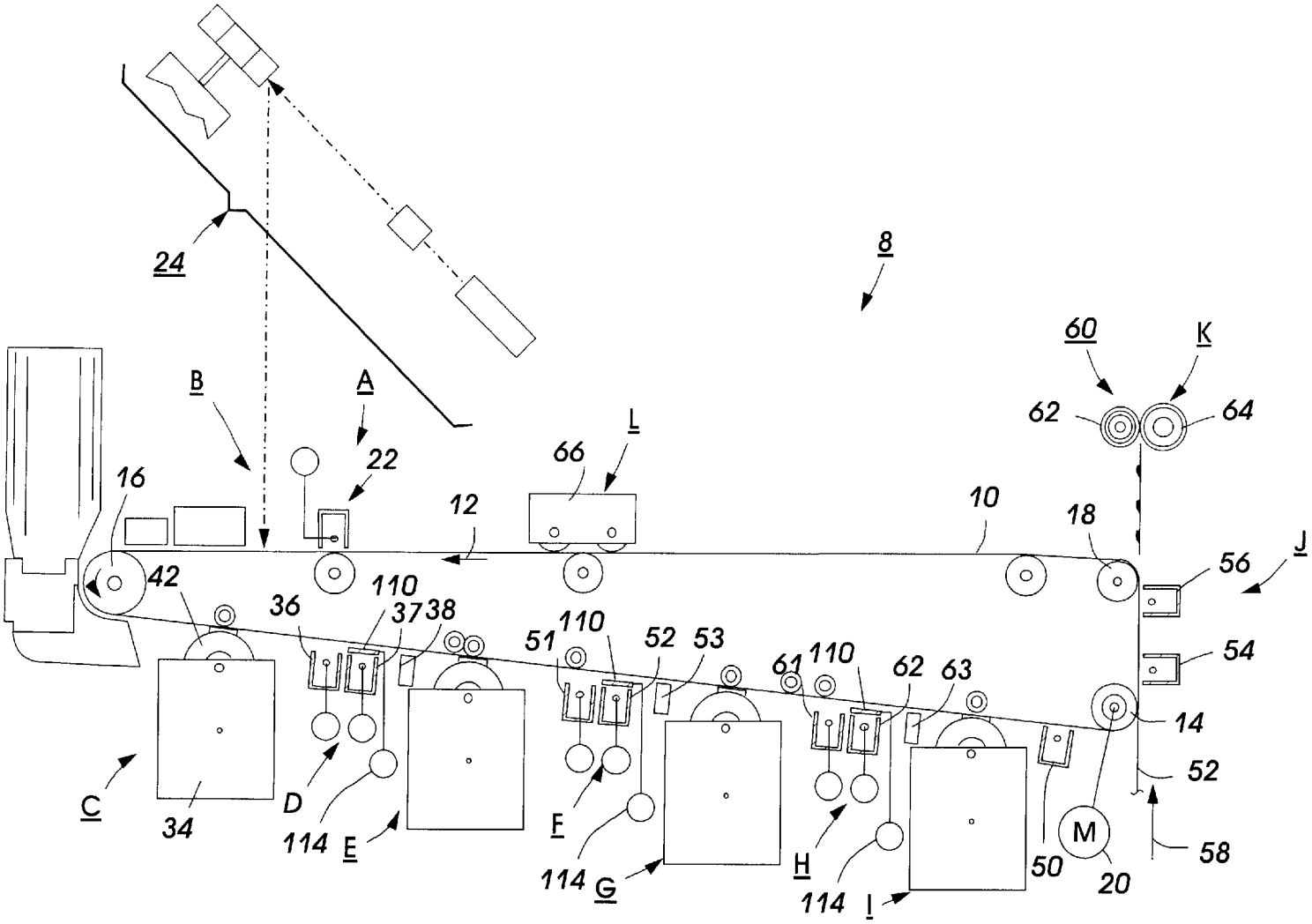

Referring initially to FIG. 11, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention.

After passing through the first exposure station B, the now exposed image area passes through a first development station C which is identical in structure with development system E, G, and I. The first development station C deposits a first color, say black, of negatively charged toner 76 onto the image area. That toner is attracted to the less negative sections of the image area and repelled by the more negative sections. The result is a first toner powder image on the image area.

For the first development station C, development system 34 includes a flexible donor belt 42 having groups of electrode arrays near the surface of the belt for transferring toner to the development zone.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged by the first recharging device 36, the image area passes to the second recharging device 37.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64, the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 9:
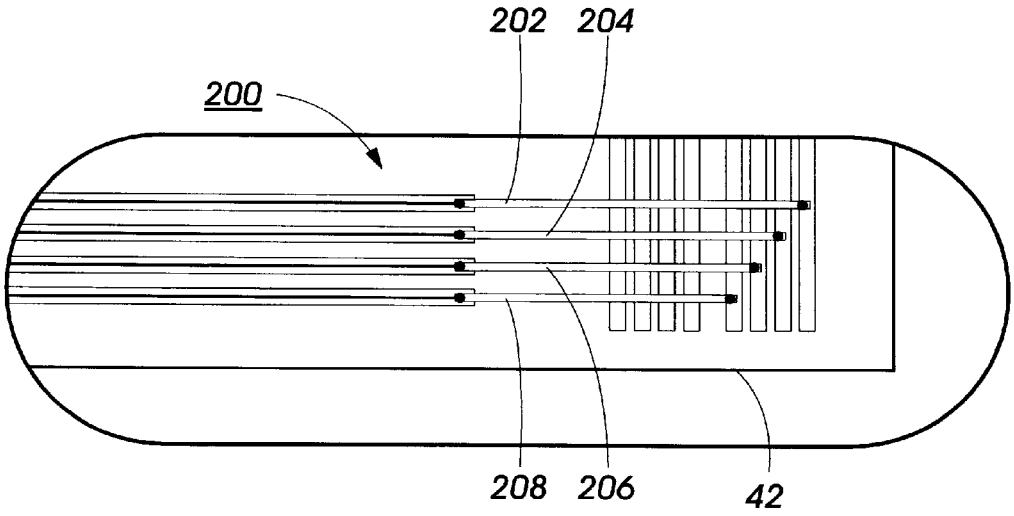
Figure 10:
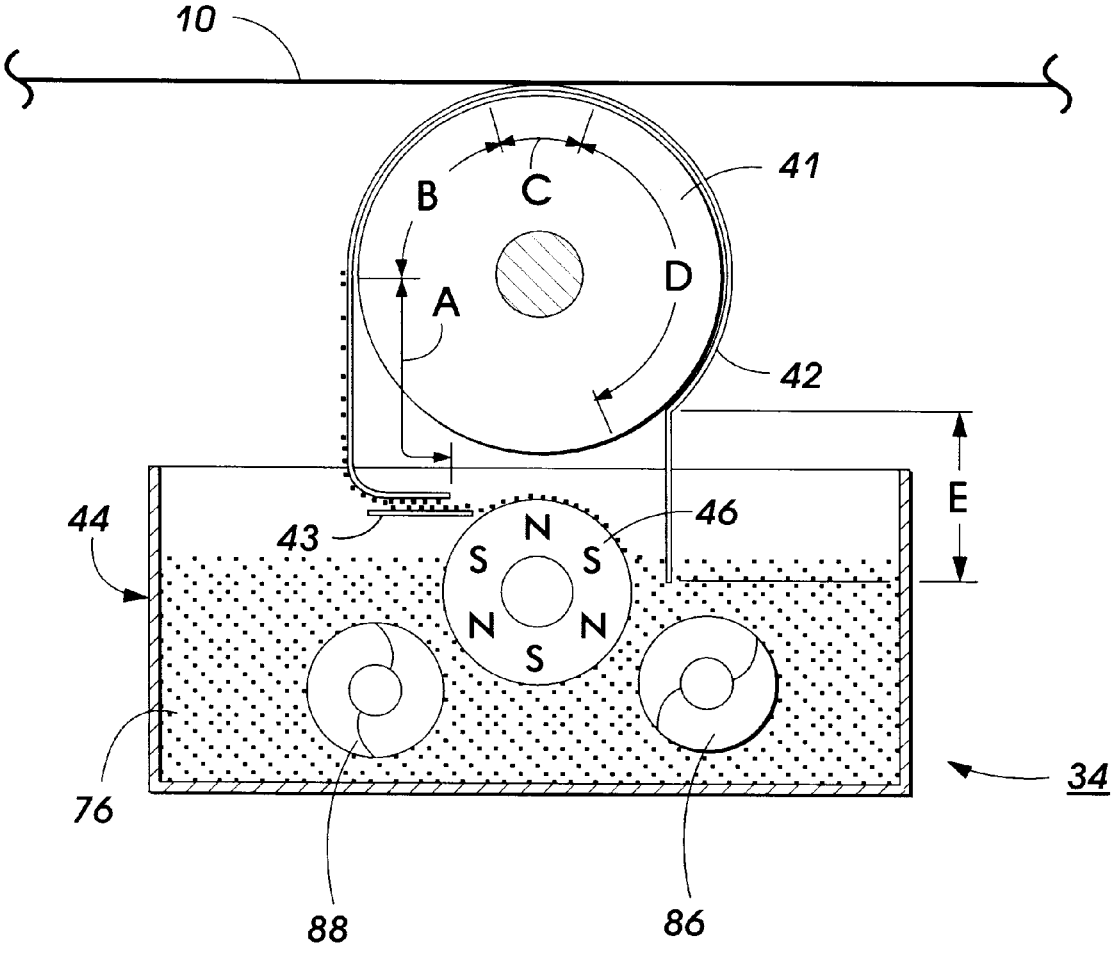

Turning to FIG. 10, which illustrates the development system 34 in greater detail, development system 34 includes a housing 44 defining a chamber 76 for storing a supply of developer material therein. Donor belt 42 is mounted on stationary roll 41 and belt portion 43 is mounted adjacent to magnetic roll 46. Donor belts 42 comprise a flexible circuit broad having finely spaced electrode array 200 thereon as shown in FIGS. 9 and 10. The typical spacing between electrodes is between 75 and 100 microns. The electrode array 200 has a four phase grid structure consisting of electrodes 202, 204, 206 and 208 having a voltage source and a wave generator 300 operatively connected thereto in the manner shown in order to supply the proper wave form in the appropriate electrode area groups A–E.

Electrode array 200 has group areas A–E in which each group area is individually addressable to perform the function of: (A) Loading toner onto the array from the housing; (B) Transferring toner to the development zone; (C) Developing the image in the development zone; (D) Transferring toner from the development zone and (E) Unloading toner from the array back into the housing. Each electrode array group area is independently addressable and operatively connected to voltage source 220 and wave generator 300. The electrodes in array group area (A) picks up the toner from the housing and transports it via the electrostatic wave set up by wave generator 300. Electrode array group areas A–E connected to the voltage source via wave generator 300 develops a traveling wave pattern is established. The electrostatic field forming the traveling wave pattern loads the toner particles from the developer sump 76 to the surface of the donor belt 42 and transports them along donor belt 42 to the development zone with the photoreceptor belt 10 where they are transferred to the latent electrostatic images on the belt 10. Thereafter, the remaining (untransferred) toner is moved by electrode array group area D to electrode group area E where remaining toner is unloaded off the belt.

To accomplish the transport function without toner sticking to the surface of the grid, we propose to use a second electrostatic wave superimposed onto the main one in order to decrease the intimate contact of the toner particles with the carrying surface while still sustaining the motion along the surface with the average velocity comparable to $v_{ph}$. The superimposed wave has in general a higher frequency and amplitude and can be either of a shorter or comparable wavelength than the main wave. Also, the superimposed wave can be either standing or running. The wave parameter combinations can be optimized for toner material properties (such as toner charge and mass), traveling wave device geometry, etc. Being constantly shaken by the superimposed wave, toner particles can spend some time in the air jumping from the surface and returning back, and in general the probability of sticking to the surface should decrease which will improve sustained toner motion on the wave. At the same time, in the development zone, this would render the toner more susceptible to the development fields. The travelling cloud height would be more controlled as compared to the case without the superimposed wave for which the cloud height is strongly influenced by the random surface scattering.

To demonstrate the idea, consider pure sinusoidal electrostatic waves. The electrostatic force on a toner particle arising from the main traveling wave is given by its components $$F_x=qE_0 \exp(-kz) \sin(\phi),$$

$$F_z=qE_0 \exp(-kz) \cos(\phi)$$

where the phase $\phi=kx-\omega t$, q is the particle charge (>0, assumed here for simplicity), and $E_0$ the maximum field strength. z=0 corresponds to the carrying surface. The conventional surfing mode can be achieved when $F_x>0$ and $F_z<0$ which yields an appropriate range of the phases between $\pi/2$ and $\pi$. The field has to be strong enough to balance the air drag and surface friction forces. A superimposed running wave would be given by the same equations with different parameters. A superimposed standing wave produces electrostatic forces that can be written as follows:

$$F_{1x}=q E_1 \exp(-k_1 z) \sin(k_1 x) \cos(\omega_1 t),$$

$$F_{1z}=q E_1 \exp(-k_1 z) \cos(k_1 x) \cos(\omega_1 t)$$

where $\omega_1$, $k_1$ and $E_1$ are the frequency, wavevector and maximum field strength for the superimposed (second) wave.

An important consideration here is that for $\omega_1>\omega$ ($\omega$ is the angular frequency of the primary or "main" wave component) the field of the secondary wave changes frequently on the "background" of the main wave. Therefore, the main wave field $F_z$ in an appropriate range of $\phi$ is capable of containing the particle motion near the surface even when the amplitude $E_1$ is larger than $E_0$. Also, with $k_1>k$ the field of the second wave falls off away from the surface faster than that of the main wave. So the second wave may have the amplitude $E_1$ sufficient to overcome the adhesion forces while the normal motion of the toners will still be contained by the main wave field $F_z$ farther away from the surface. The calculations following below confirm these considerations.

For simulation purposes assume that the "average" toner interaction with the surface can be characterized with the restitution coefficient $k_r$, coefficient of friction $k_f$, and the adhesion force, or the detachment field strength $F_d$. The adhesion force is assumed to scale as the image force $F_a=-F_d(z_a/(z+z_a))^2$. The continuity of the friction forces can be expressed as $F_f=k_f N\exp(-z/l_f)$ where $z_a$ and $l_f$ are the length-dimension parameters and N the normal force. $F_a$ here has only the normal component and $F_f$ only the longitudinal component.

For the following examples, $k_r=0.5$ and $k_f=0.6$ with $z_a=3$ microns and $l_f=2$ microns. The toner tribo was set to 10 units. The geometrical parameters were consistent with the traveling wave grids that were discussed previously. The wavelength of the main wave was set to 800 microns and the frequency $f=\omega/2\pi=1$ kHz corresponding to $v_{ph}=0.8$ m/s. The second waves for the examples given are standing ones. The conclusions have been confirmed for other cases examples of which are not given here. FIGS. 1 to 7 show toner trajectories and phases for various choices of wave parameters.

Figure 1A:
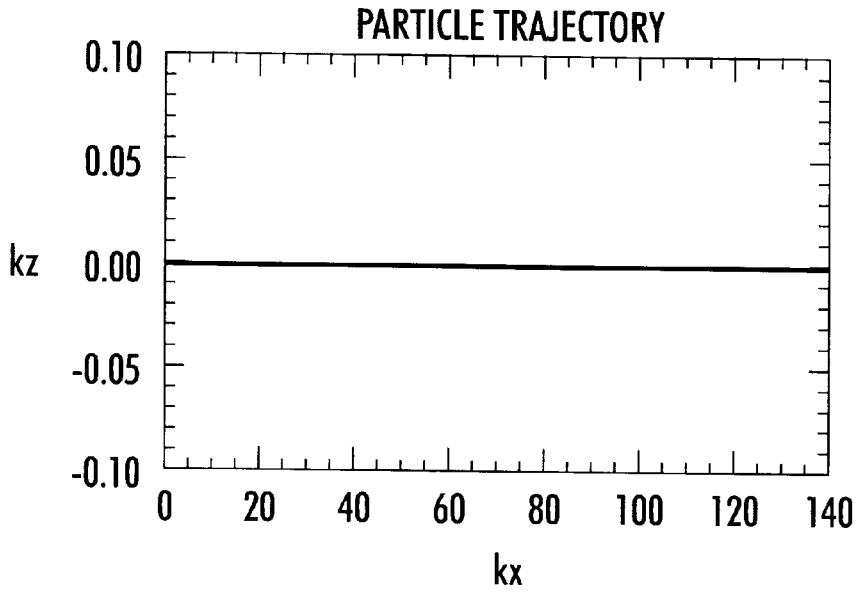
FIGS. 1–7 illustrate particle trajectories (1A–7A) along with accompanying particle phases (1B–7B) and are described in more detail below.
Figure 1B:
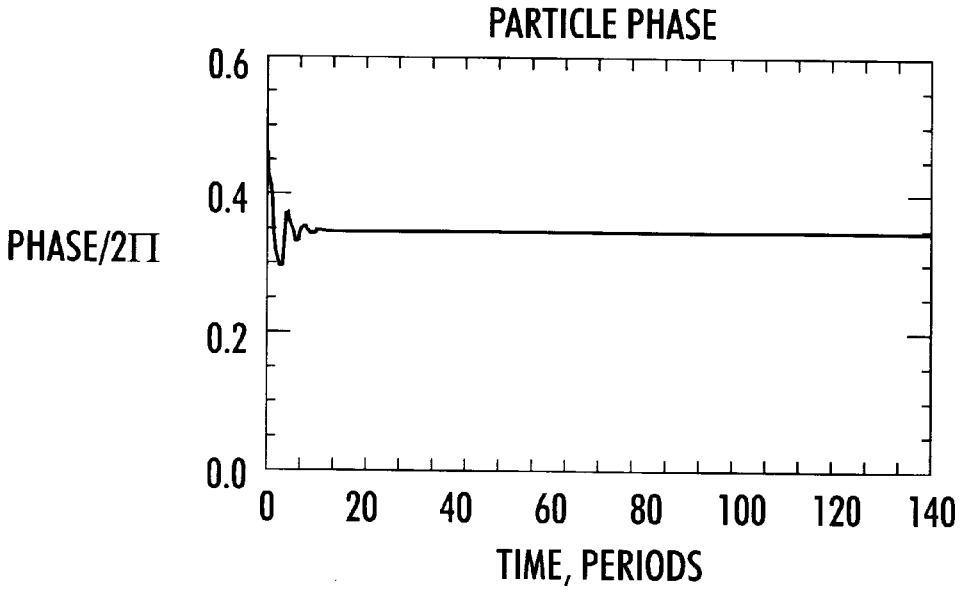

FIG. 1: Here the average adhesion is low, $F_d=1$ V/micron and the velocity relaxation time due to air drag $\tau=200$ microseconds. The traveling wave has $E_0=2$ V/micron and no second wave is superimposed. As a result, the particle slides along the surface in close attachment to it with a phase that balances the friction and applied $F_x$.

Figure 2A:
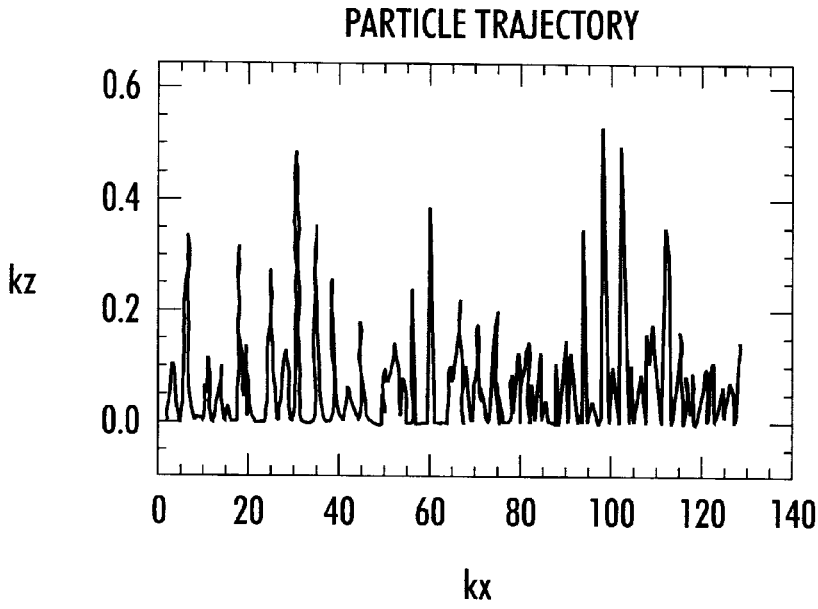
Figure 2B:
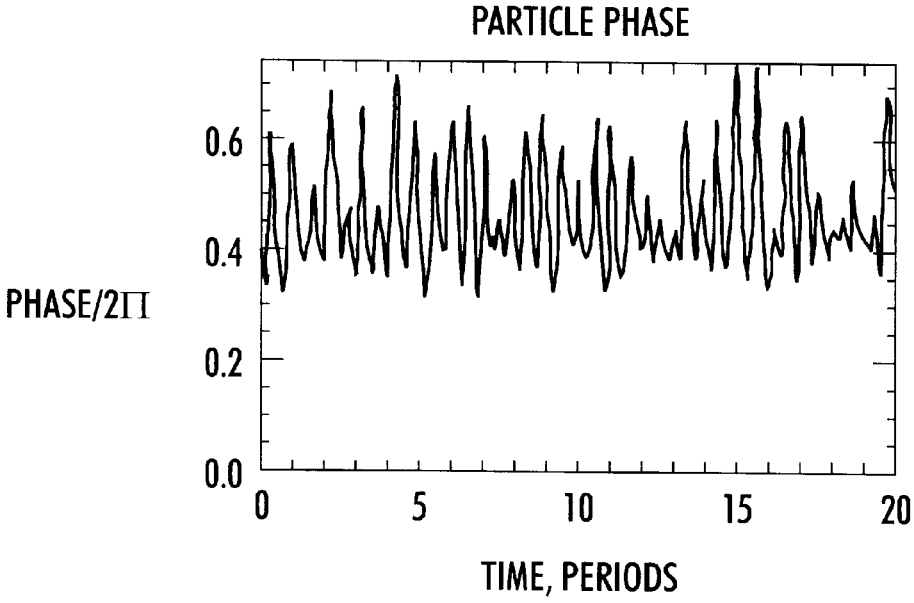

FIG. 2: A second wave is superimposed with $k_1=4k$, $f_1=\omega_1/2\pi=10$ kHz and $E_1=5$ V/micron. The particle position with respect to the main wave oscillates, the particle is constantly detached from the surface and launched in the air during the motion. Its average velocity is $v_{ph}$.

Figure 3A:
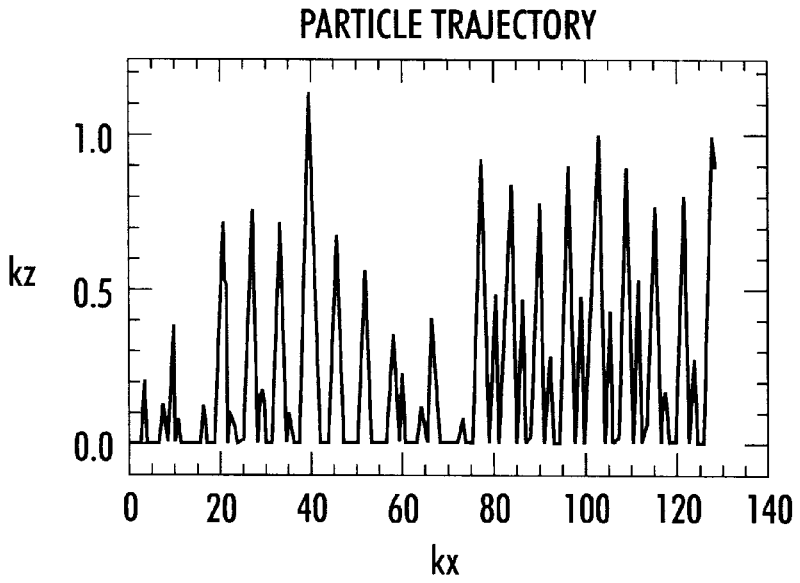
Figure 3B:
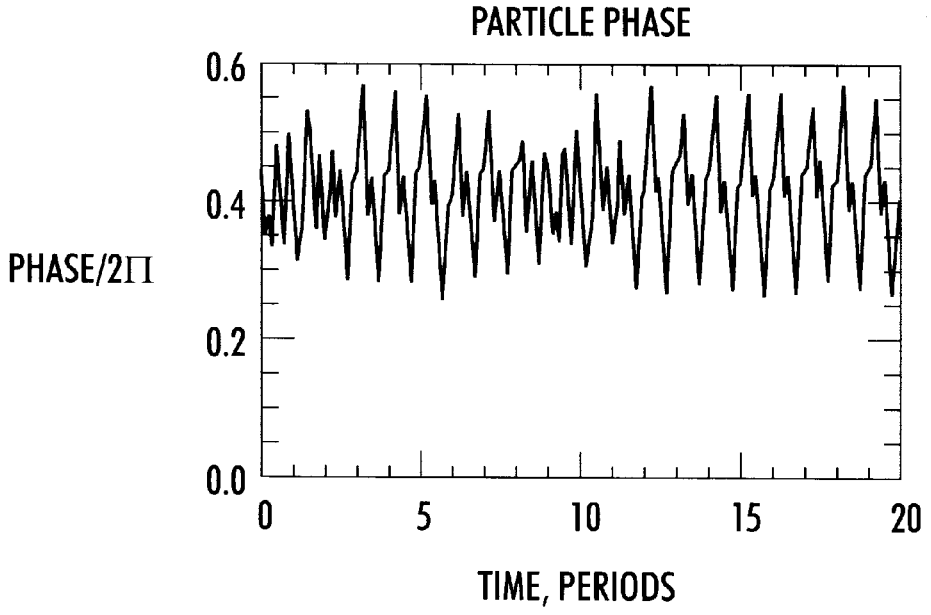

FIG. 3: A second wave is superimposed with $k_1=k$, $f_1=4$ kHz and $E_1=3$ V/micron. The jumps are now higher and longer lasting. The particle continues to be moved by the traveling wave with the velocity $v_{ph}$.

Figure 4A:
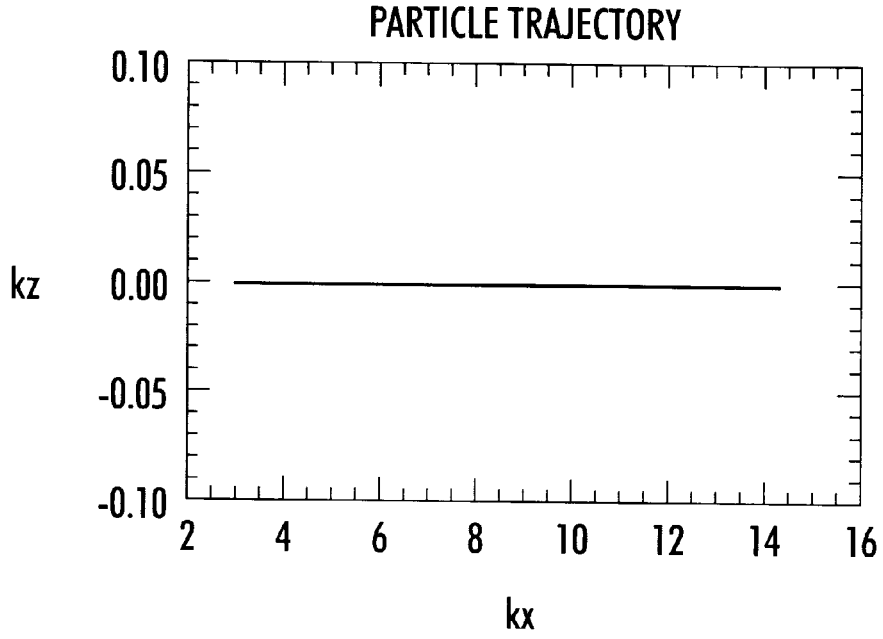
Figure 4B:
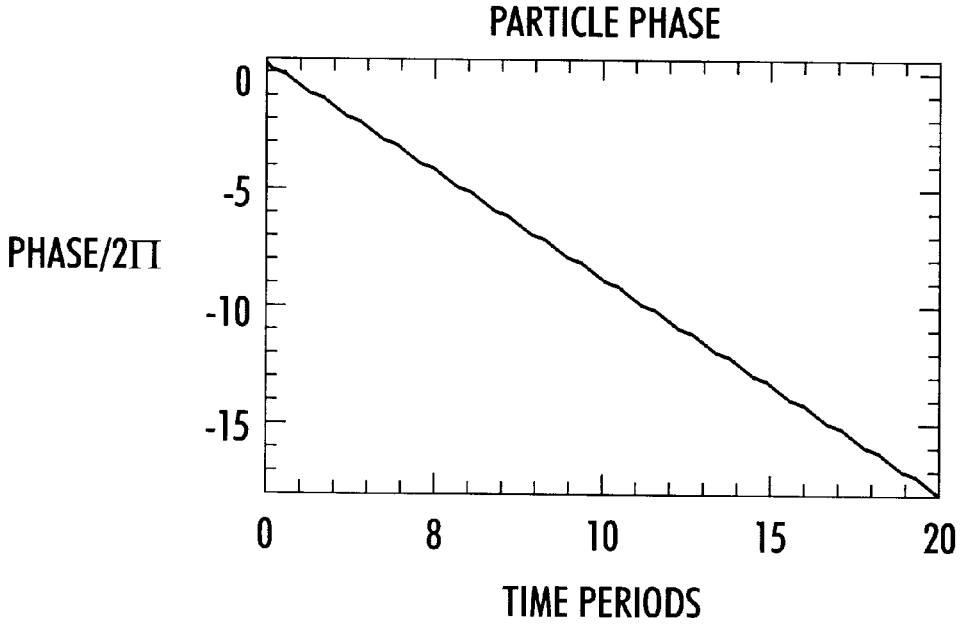

FIG. 4: Here the average adhesion is higher, $F_d=3$ V/micron and $\tau=100$ microseconds. No second wave is superimposed. With $E_0=2$ V/micron, the particle is unable to catch the traveling wave. It stays attached to the surface and slowly moves experiencing kicks from the wave.

Figure 5A:
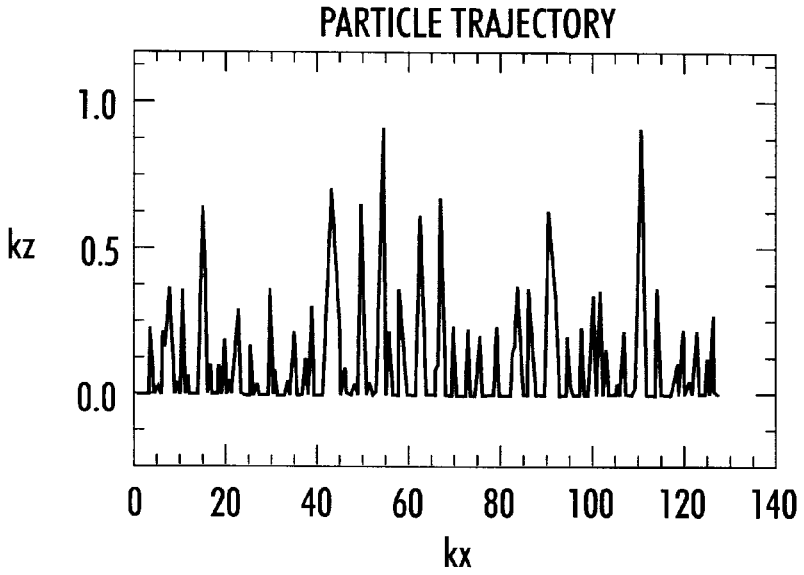
Figure 5B:
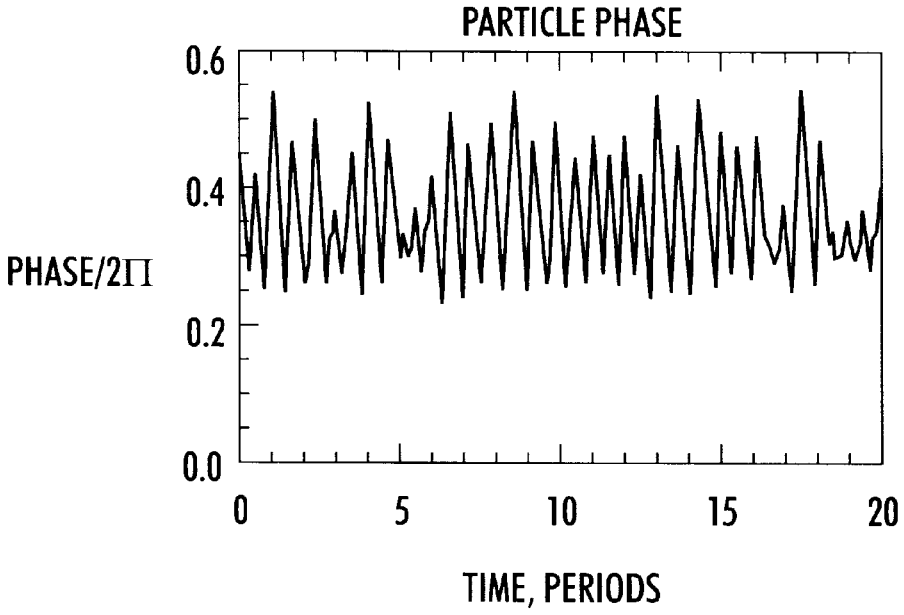

FIG. 5: As in FIG. 4 but a second wave is now superimposed with $k_1=4$ k, $f_1=10$ kHz and $E_1=5$ V/micron. Being lifted in the air, the particle catches the traveling wave.

Figure 6A:
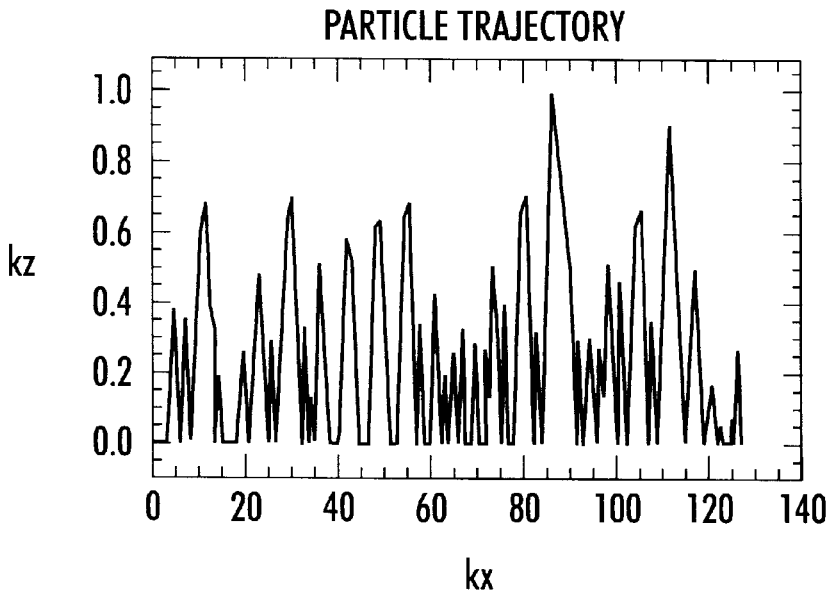
Figure 6B:
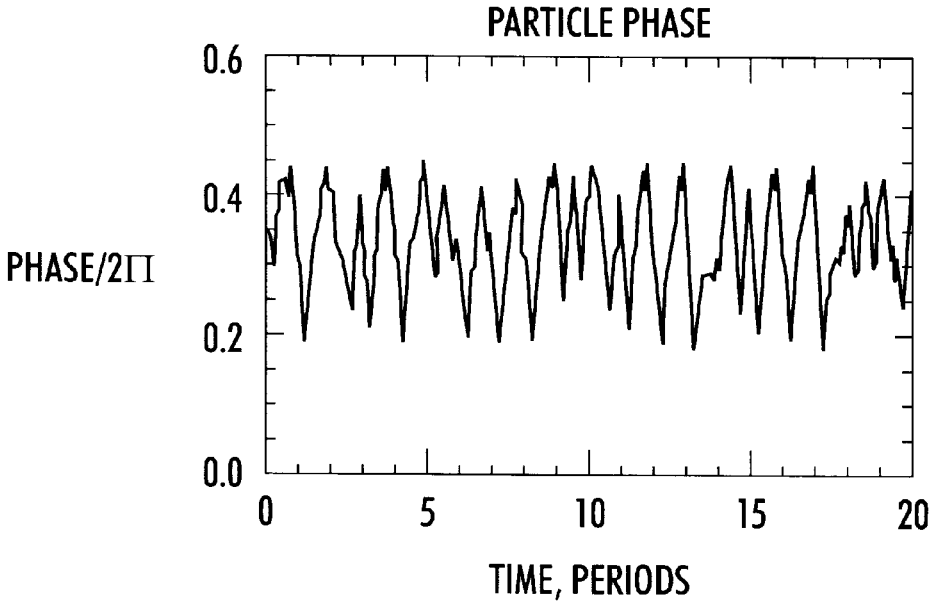

FIG. 6: A second wave is superimposed with $k_1=k$, $f_1=8$ kHz and $E_1=5$ V/micron. The particle catches the traveling wave, the jumps are quite high and phases smaller than $\pi/2$ can occur.

Figure 7A:
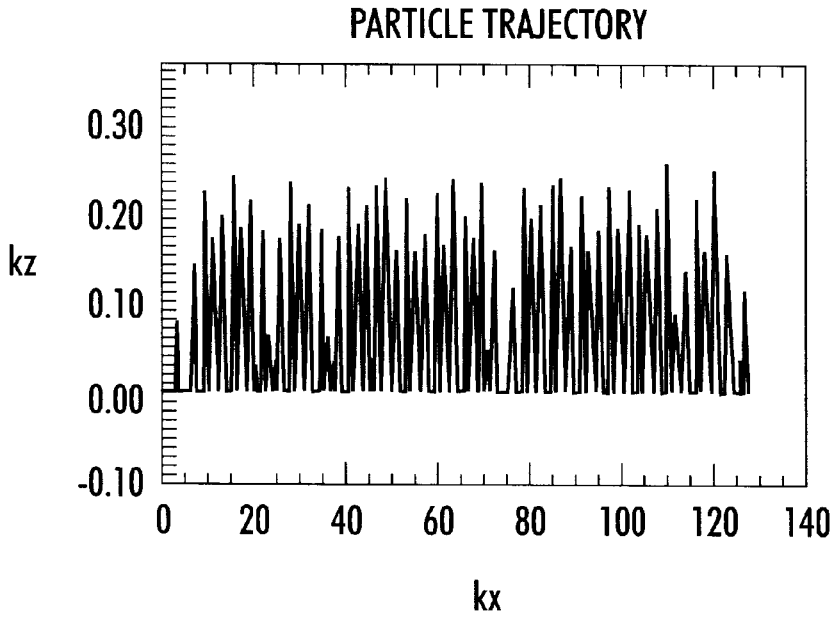
Figure 7B:
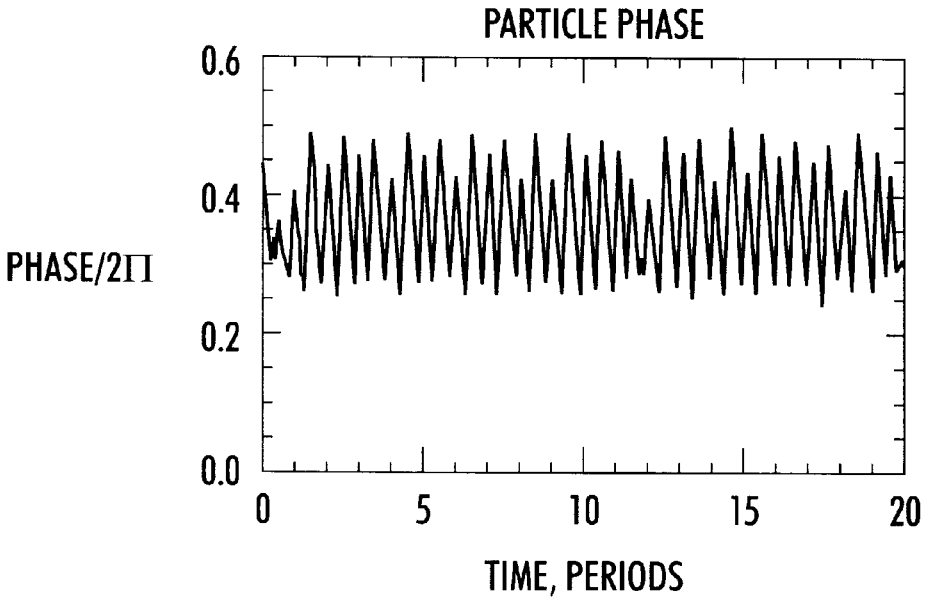
Figure 8:
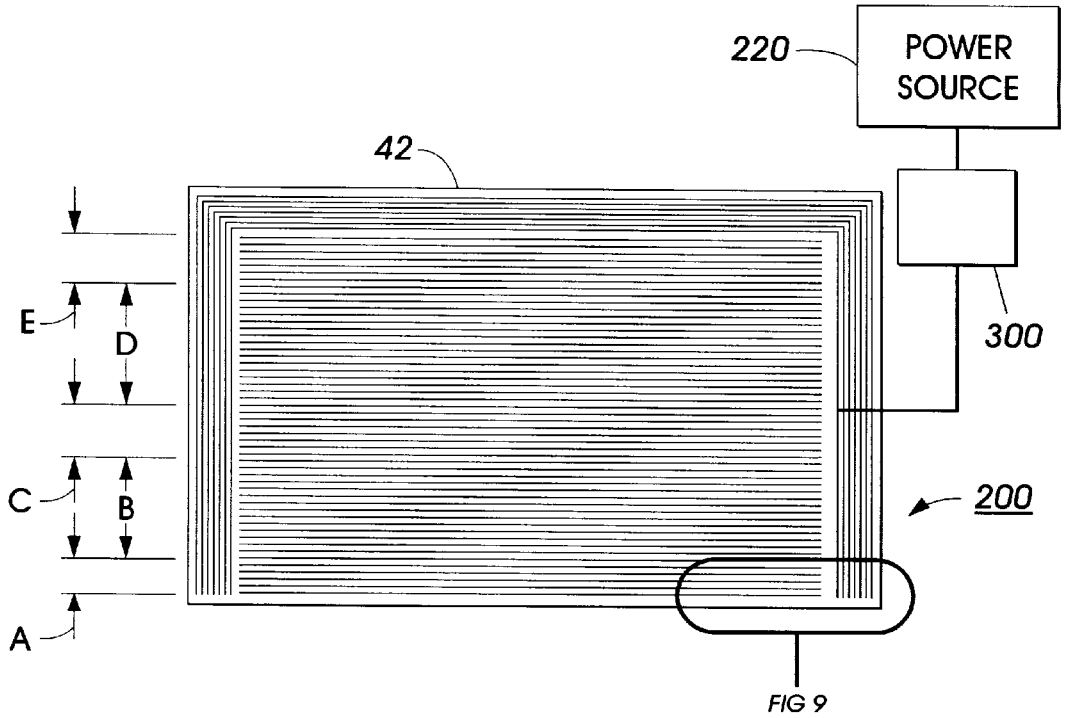
FIGS. 8–11 show illustrative printing and development apparatuses.

FIG. 7 as in FIG. 2, but the main wave's $E_0=3$V/micron. The normal motion is more strongly contained now and the phases move to the larger values.

These numerical examples show there exists a range of parameters where a superimposed second wave effectively provides a detachment function by shaking toner particles while at the same time containing the toners close to the carrying surface. Transport along the surface proceeds at the wave phase velocity. For such a mode of transport, the formation of adhesive toner-surface bonds should be significantly decreased and even some self-cleaning can be expected. The usable (consistent with non-sticking) range of $v_{ph}$ could be increased at the lower side. The surfing motion can be sustained with most favorable phases closer to $\pi$ where the containment and restoring potentials of the wave are maximal. With particles being frequently away from the surface one could also expect smaller changes in the toner charge because of the lowered frequency of contact with the carrying surface. Evidently from the illustrative figures of particle trajectories, the second wave also raises the height of the traveling toner clouds thereby making them more susceptible to development fields in the development region, a very useful property.

With the opportunity to vary frequencies, amplitudes and relative spatial scales especially in the context of practical grids with finite electrodes, superimposed electrostatic waves can provide additional means for "smart" handling of toner particles for purposes other than those described in the present invention.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a chamber for storing a supply of developer material comprising toner;

a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; and a multi-phase voltage source operatively coupled to said electrode array, for generating a first electrodynamic wave pattern for moving toner particles along the surface of said electrode array to and from a development zone and generating a second electrodynamic wave to provide a fast oscillating-like toner motion along and perpendicular to the surface of said electrode array.

2. The apparatus of claim 2, wherein said second electrodynamic wave is superimposed onto the average translational motion of said first ectrodynamicwave.

3. The apparatus of claim 2, wherein said second electrodynamic wave has a substantially higher frequency and amplitude than said first electrodynamic wave.

4. The apparatus of claim 2, wherein said second electrodynamic wave has a shorter or comparable wavelength than first electrodynamic wave.

5. The apparatus of claim 2, wherein said second electrodynamic wave is superimposed onto said first electrodynamic wave in standing or running mode.

6. The apparatus of claim 1, further comprising means for adjusting said second electrodynamic wave to control of the height of the traveling cloud of charged particles.

7. A method for transporting particles along a travel wave grid comprising the steps of:

applying a traveling wave to transport particles along propagation direction of said travel wave, while the applying a second wave to shake said particles to decrease their contact with the surface of said travel wave grid.

* * * * *